United States Patent [19]

Kazami et al.

[11] 4,245,021

[45] Jan. 13, 1981

[54] ELECTROPHOTOGRAPHIC ELEMENT HAVING CHARGE TRANSPORT LAYER

[75] Inventors: Takeo Kazami; Kiyoshi Sakai, both of Tokyo; Mitsuru Hashimoto, Hino; Masaomi Sasaki, Tokyo; Kyoji Tsutsui, Tokyo; Masafumi Ohta, Yokohama, all of Japan

[73] Assignee: Ricoh Co., Ltd., Tokyo, Japan

[21] Appl. No.: 11,063

[22] Filed: Feb. 12, 1979

[30] Foreign Application Priority Data

Feb. 17, 1978 [JP] Japan ..... 53-17445

[51] Int. Cl.[3] ..... G03G 5/09

[52] U.S. Cl. ..... 430/58; 430/59; 430/900

[58] Field of Search ..... 96/1.5, 1.6; 430/58, 430/900, 59

[56] References Cited

U.S. PATENT DOCUMENTS

| | | | |
|---|---|---|---|
| 3,791,824 | 2/1974 | Bauer et al. | 430/900 X |
| 3,953,207 | 4/1976 | Horgan | 430/58 |
| 3,955,978 | 5/1976 | Rochlitz et al. | 96/1.5 |

*Primary Examiner*—John D. Welsh

*Attorney, Agent, or Firm*—Blanchard, Flynn, Thiel, Boutell & Tanis

[57] ABSTRACT

An electrophotographic element according to the present invention exhibits an exceedingly high sensitivity and it comprises (1) an electroconductive support, a charge producing layer consisting essentially of a charge producing substance and a charge transport layer consisting essentially of a charge transport substance having the following general formula and a binder, the last-mentioned two layers being superposed in that order or vice versa on said support, or (2) an electroconductive support and a photosensitive layer, superposed thereon, and consisting essentially of a charge producing substance, a charge transport substance having said general formula and a binder:

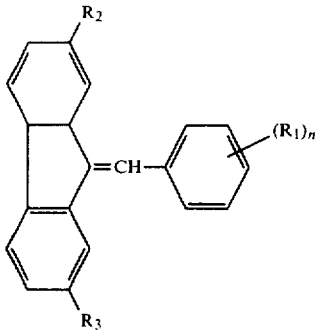

(wherein n is an integer of 1 or 2, $R_1$ stands for hydrogen atom or an alkyl, nitro, dialkylamino, alkoxy, nitrile or carboxylic ester group, and $R_2$ and $R_3$ stand for hydrogen or halogen atom or nitro or dialkylamino group respectively).

16 Claims, No Drawings

ELECTROPHOTOGRAPHIC ELEMENT HAVING CHARGE TRANSPORT LAYER

BACKGROUND OF THE INVENTION

The present invention relates to an improvement of electrophotographic elements.

DESCRIPTION OF THE PRIOR ART

Highly sensitive electrophotographic elements have recently been proposed which comprise the combination of a substance capable of producing charges on irradiation by light (which will hereinafter be called a charge producing substance) with a substance capable of transporting the thus produced charges (which will hereinafter be called a charge transport substance). For instance, U.S. Pat. No. 3,791,826 discloses an electrophotographic element which comprises the provision of a charge transport layer on a charge producing layer, U.S. Pat. No. 3,573,906 discloses an electrophotographic element which comprises the provision of a charge producing layer on a charge transport layer in contrast with the first mentioned patent, and U.S. Pat. No. 3,764,315 further discloses an electrophotographic element having a photosensitive layer which comprises dispersing a charge producing substance, in a charge transport substance respectively. In these types of electrophotographic elements, it is the present condition that a multiplicity of charge producing substances have heretofore been proposed as useful but truly useful charge transport substances have scarcely been proposed. Truly useful charge transport substances referred to herein are those capable of permeating light of a wave length, which is sufficient to allow a charge producing substance to produce charges, fully into the charge producing substance, and retaining, when charged, an electric charge to the full, and rapidly transporting charges produced in the charge producing substance.

SUMMARY OF THE INVENTION

The object of the present invention is to provide an electrophotographic element further improved in sensitivity by using a truly useful charge transport substance.

In other words, the present invention relates to (1) an electrophotographic element which comprises an electroconductive support, a charge producing layer consisting essentially of a charge producing substance and a charge transport layer consisting essentially of a charge transport substance having the following general formula and a binder, the last-mentioned two layers being superposed in that order on said support and (2) an electrophotographic element which comprises an electroconductive support and a photoconductive layer, superposed thereon, consisting essentially of a charge producing substance, a charge transport substance having said general formula and a binder:

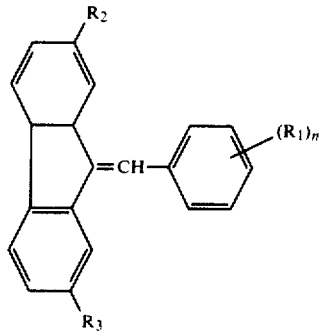

(wherein n is an integer of 1 or 2, $R_1$ stands for hydrogen atom or an alkyl, nitro, dialkylamino, alkoxy, nitrile or carboxylic ester group, and $R_2$ and $R_3$ stand for hydrogen or halogen atom or nitro or dialkylamino group respectively).

The present invention is characterized by using, as the charge transport substance, a compound represented by the aforesaid general formula. This compound itself is not novel, and the usability of it as an electrophotographic photoconductor is disclosed in, for instance, U.S. Pat. No. 3,331,687. Examples of the charge transport substances are listed in Table 1.

TABLE 1

| Formula | Name |
|---|---|
| (1) 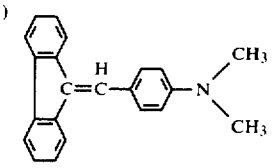 | 9-(4'-dimethylaminobenzylidene)fluorene |
| (2) 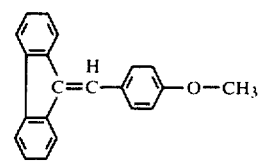 | 9-(4'-methoxybenzylidene)-fluorene |
| (3) 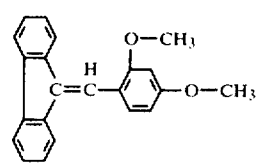 | 9-(2',4'-dimethoxybenzylidene)-fluorene |
| (4) 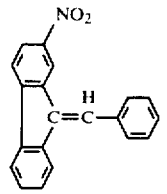 | 2-nitro-9-benzylidene-fluorene |
| (5) 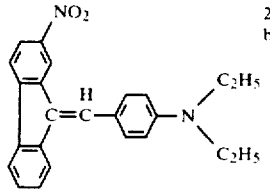 | 2-nitro-9-(4'-diethylamino-benzylidene)-fluorene |

TABLE 1-continued

| Formula | Name |
|---|---|
| (6) 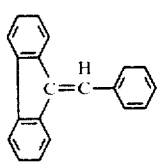 | 9-benzylidene-fluorene |
| (7) 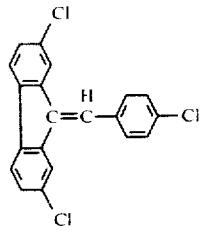 | 2,7-dichloro-9-(4'-chloro-benzylidene)-fluorene |
| (8) 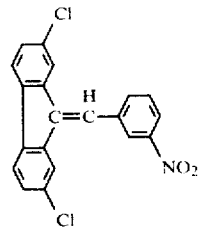 | 2,7-dichloro-9-(3'-nitro-benzylidene)-fluorene |
| (9) 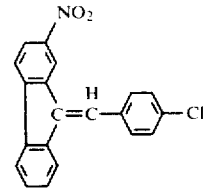 | 2-nitro-9-(4'-chlorobenzylidene)-fluorene |

However, attention should be paid to the fact that in the present invention the compound represented by the aforesaid general formula functions scarcely or does never function as a photoconductive substance, but rather, it does function as a charge transport substance exclusively. In order that this compound may function as a photoconductive substance, it must be excited by absorbing irradiated light. But the absorption of this compound was so weak in the visible region that it could not be put to practical use without adding a sensitizer. And even when a sensitizer was used in conjunction therewith, said compound was recognized to be inferior in sensitivity. However, it was found that this compound, when combined with a charge producing agent for the purpose of making an electrophotographic element, made the resulting element of a high sensitivity that had been unimaginable by any stretch of the imagination.

The charge producing substance used in the electrophotographic elements (1) and (2) according to the present invention includes various inorganic substances, for instance, such as, Se, SeTe, SeAs, SeTeAs, CdSe, ZnS, CdS, Cadmium sulfoselenide and so forth, and additionally includes, as organic substances, azoxybenzene-, disazo-, trisazo-, benzimidazole-, polycyclic quinone-, indigoid-, quinacridone-, phthalocyanine-, perylene-, or squalic methine-pigment as disclosed in Japanese laid-open patent specifications Nos. 37543/1972, 37544/1972, 18543/1972, 18544/1972, 30329/1972, 30330/1972, 30331/1972, 30332/1972, 43942/1973, 70538/1973, 1231/1974, 105536/1974, 7521/1975, 92738/1975, etc. And any substance can be used in the present invention which is capable of producing charges on irradiation by light, not to speak of the above enumerated conventional substances.

In the electrophotographic element of the type (1) according to the present invention the charge producing layer is very thin, and the thickness is preferably in the range of from about 0.05 to 20 μm, preferably 0.1-5 μm. In contrast, the charge transport layer is comparatively thick, and the thickness is preferably in the range of from about 10 to 100 μm. The charge producing layer is generally formed by means of evaporation deposit or by dispersing a charge producing substance in a binder, but as the occasion demands, it may also be formed by dispersing or dissolving a charge producing substance in an organic liquid, coating the electroconductive support with the resulting dispersion or solution and drying, as proposed in Japanese laid-open patent specifications Nos. 8981/1972 and 55643/1977. When the charge producing layer is formed by dispersing a charge producing substance in a binder, the charge producing substance should preferably be pulverized as fine as possible so that the total surface area may be increased. In this sense, the mean grain size of this substance is preferably in the range of about 0.1 μm or less. The binders which may be used herein include all of those substances which have been employed as binders for electrophotographic photosensitive layers such as acrylic resin, styrene resin, alkyd resin, epoxy resin, polyamide, silicone resin, polyvinyl chloride, polyvinylidene chloride, phenol resin, polyurethane, polyester, polycarbonate, polyacetal, polybutyral, vinyl chloride-vinyl acetate copolymer, polyethylene, polybutadiene, polyvinyl alcohol, various kinds of celluloses, etc.

Next, in the photosensitive layer of the type (1) the charge transport layer is formed by dissolving the charge transport substance consisting of the compound represented previously by the general formula together with a binder in an organic solvent, coating the resulting solution on the support and drying. The binders applicable to the charge transport layer include all of those substances which have been employed as binders in conventional electrophotographic photosensitive layers. And they may be used in combination with other charge transport substances, for instance, such as polyvinyl carbazole, polyvinyl anthracene, polyvinyl pyrene, pyrene-formaldehyde condensate, etc., or they may be mixed with conventional additives such as plasticizer, hardening agent and so forth.

In any case, the weight proportion of the compound having the aforesaid general formula incorporated in the charge transport layer to the charge transport layer is in the range of from 10 to 60%.

The present invention basically consists of the aforesaid two types of photosensitive layers, but as modifications of the type (1) there can be enumerated, for example, the construction in which the charge transport layer is formed on the support and the charge producing layer is superposed on said layer. In this case the thicknesses of the charge producing and transport layers may be identical with those of the charge producing and transport layers of the electrophotographic element of the type (1).

In any case, when a conventional electrographic process is performed using the electrophotographic element constructed such that a charge transport layer is uppermost, said plate effectively should be charged negatively in the electrification step, and in the case of the electrophotographic element constructed such that a charge producing layer is uppermost, it effectively should be charged positively.

The electrophotographic element of the type (2) according to the present invention is prepared by providing on an electroconductive support, a photosensitive layer formed by dispersing a charge producing pigment in a mixture of charge transport substance and binder. In more detail, this type of electrophotographic element is prepared in such a manner that a charge transport substance and a binder are dissolved in a suitable solvent, a charge producing substance is dispersed in the resulting solution, and this dispersion is coated on an electroconductive support and dried so that the dry thickness may preferably be in the range of from about 3 to 100 μm. The charge producing substance used herein is required to be so fine that the majority of it may be present in the molecular state. And the mean grain diameter of the charge producing substance is preferably about 0.1 μm or less. The quantity of the charge transport substance used is in the range of from about 10 to 60%, preferably 30 to 50% of the weight of the photosensitive layer. The quantity of the charge producing substance used is preferably in the range of from about 1 to 50%, preferably 1-20% on the same basis. Also in this case, it is of course possible to use the charge transport substance of the present invention in combination with a conventional charge transport substance, and it is also possible to add an additive such as plasticizer, remover or the like to the charge transport substance of the present invention.

The above-mentioned are explanations about the basic construction and modifications of the electrophotographic element according to the present invention. However, some other modifications are conceivable, and it may readily be understood that they of course fall within the scope of the present invention. As such modifications, for instance, it is conceivable to interpose a conventional barrier layer or adhesive layer made of aluminum oxide, polyamide, polyurethane or the like between the support and photosensitive layers, and to laminate thereon a thin protective layer made of polyamide, polycarbonate, polyurethane or the like.

DESCRIPTION OF THE PREFERRED EMBODIMENTS OF THE INVENTION

Hereinafter will be give the preferred embodiments of practicing the present invention.

EXAMPLE 1

A dispersion of charge producing pigment was prepared by pulverizing and mixing 2 parts of Dian Blue (CI 21180) and 93 parts of tetrahydrofuran in a ball mill. This dispersion was applied onto an aluminum-vacuum evaporated polyester film by means of a doctor blade and air-dried, thereby forming a 1μ-thick charge producing layer. Subsequently, a charge transport layer forming liquid was prepared by mixing 2 parts of charge transport substance having the following structural formula:

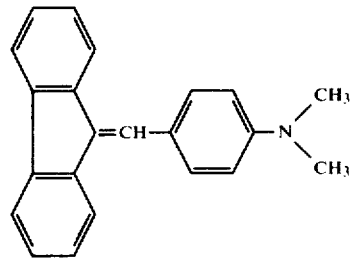

3 parts of polycarbonate (namely, Panlite L manufactured by TEIJIN K.K.) and 45 parts of tetrahydrofuran. The thus obtained liquid was applied onto the above-mentioned charge producing layer by means of a doctor blade. The same was dried at a temperature of 100° C. for 10 minutes and thus a 9μ-thick charge transport layer was formed, whereby there was provided an electrophotographic element according to the present invention.

This electrophotographic element was subjected to −6 KV corona discharge for 20 seconds by means of an electrostatic copy paper tester (namely, SP 128 model manufactured by KAWAGUCHI DENKI SEISAKUSHO K.K.) and thus charged negatively. Then, the thus charged element was left standing in the dark for 20 seconds and then the surface potential Vpo(V) thereof was measured. Subsequently, this element was subjected to the irradiation of light from a tungsten lamp so that the intensity of illumination may become 20 lux. on the surface thereof, whereby the time (second) required for the surface potential to be reduced to one-half of Vpo was calculated to obtain the intensity of light E1/2 (lux·sec.) (namely, sensitivity). The results thus obtained were as follows:

Vpo = −1360 V:E1/2 = 5.1 lux·sec.

EXAMPLE 2

A dispersion of charge producing pigment was prepared by pulverizing and mixing a mixture consisting of 3 parts of a compound having the structural formula:

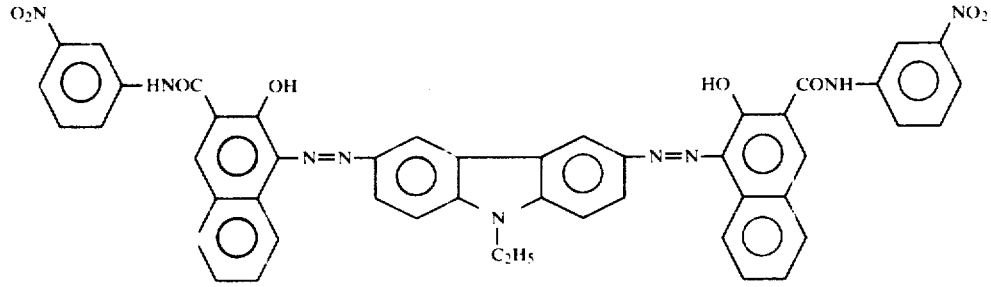

1 part of polyester resin (namely, PEAD49000 manufactured by Du Pont) and 96 parts of tetrahydrofuran in a ball mill. This dispersion was applied onto an aluminum-vacuum evaporated polyester film by means of a doctor blade and dried at a temperature of 80° C. in a drier for 5 minutes, thereby forming a 1μ-thick charge producing layer. Subsequently, a charge transport layer forming liquid was prepared by mixing 2 parts of charge transport substance having the structural formula:

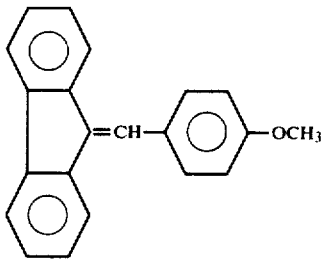

3 parts of polycarbonate (namely: Panlite L manufactured by TEIJIN K.K.) and 45 parts of tetrahydrofuran. The thus obtained liquid was applied onto the above-mentioned charge producing layer by means of a doctor blade. The same was dried at a temperature of 100° C. for 10 minutes and thus a 10μ-thick charge transport layer was formed, whereby there was provided an electrophotographic element according to the present invention. This electrophotographic element was negatively charged by repeating the same procedure as Example 1. Then, Vpo and E1/2 were measured with said electrophotographic element. The results thus obtained were as follows:

Vpo = −1200 V:E1/2 = 11.7 lux·sec.

EXAMPLE 3

The same procedure as Example 2 was repeated except that the charge producing pigment was replaced by a trisazo pigment having the structural formula:

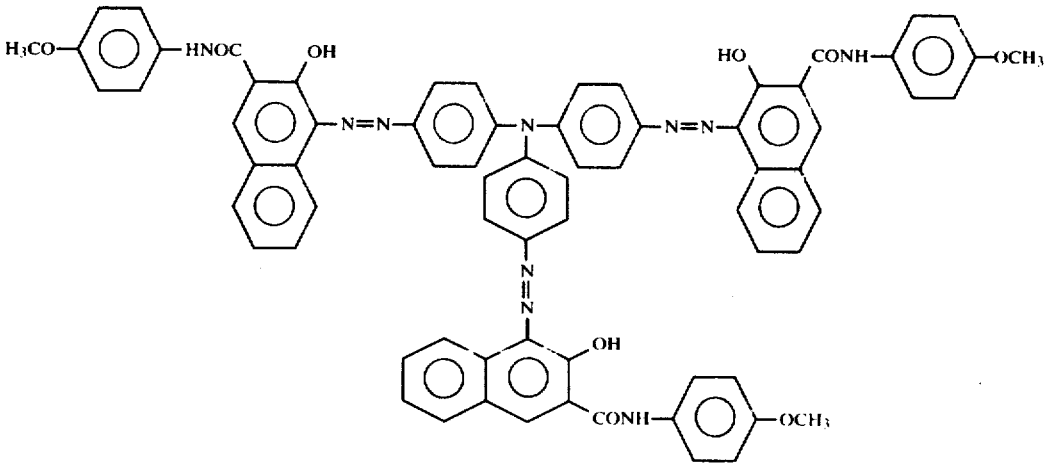

and the charge transport substance was replaced by a substance having the structural formula:

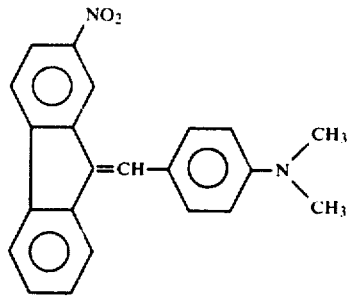

thereby providing an electrophotographic element. Then, Vpo and E1/2 were measured with said electrophotographic element. The results thus obtained were as follows:

Vpo = −1170 V:E1/2 = 5.6 lux·sec.

EXAMPLE 4

The same procedure as Example 2 was repeated except that the charge producing pigment was replaced by a diazo pigment having the structural formula:

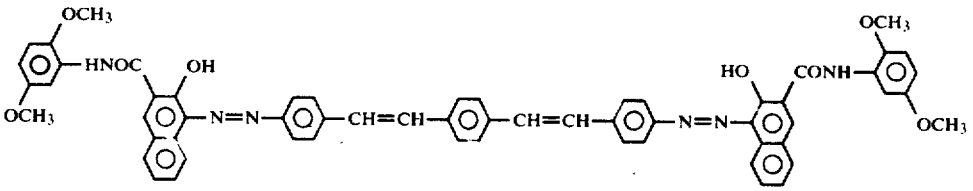

and the charge transport substance was replaced by a substance having the structural formula:

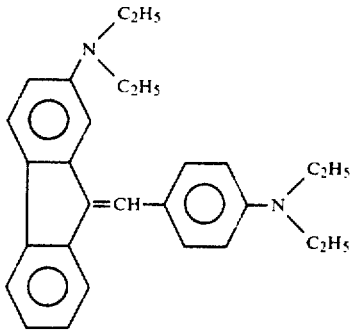

thereby providing an electrophotographic element. Then, Vpo and E1/2 were measured with said electrophotographic element. The results thus obtained were as follows:

Vpo = −1140 V:E1/2 = 3.4 lux·sec.

EXAMPLE 5

The electrophotographic elements obtained in Examples 1 to 4 were respectively charged negatively by means of a copying machine on the market and then subjected to the irradiation of light through originals with the formation of electrostatic latent images. The electrostatic latent images were developed by means of dry developers having positively charged toners. The developed images were electrostatically transferred onto papers of fine quality and fixed. The obtained images were of high distinction. The images obtained by using wet developers were also distinct to the same extent as in the former.

EXAMPLE 6

A charge producing layer was formed by vacuum evaporating selenium onto an about 300μ-thick aluminum plate so as to have a thickness of 1μ. Subsequently, a charge transport layer-forming liquid was prepared by mixing 2 parts of a compound having the structural formula:

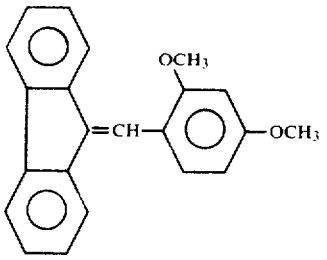

3 parts of polyester resin (namely, Polyester Adhesive 49000 manufactured by Du Pont) and 45 parts of tetrahydrofuran. This liquid was applied onto the charge producing layer by means of a doctor blade, air-dried and further dried under reduced pressure with the formation of a 10μ-thick charge transport layer, thereby resulting in an electrophotographic element of the present invention.

Vpo and E1/2 were measured with this electrophotographic element through the same procedure as Example 1. The obtained results were as follows:

Vpo = −1430 V:E1/2 = 5.0 lux·sec.

EXAMPLE 7

A charge producing layer was formed by vacuum evaporating perylene pigment

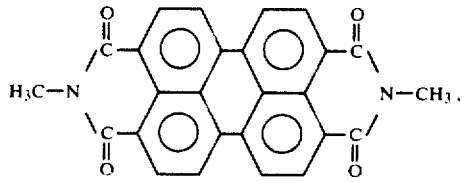

in place of the selenium used in Example 6, so as to have a thickness of 0.3μ. Subsequently, the same procedure as Example 6 was repeated except that the charge transport substance was replaced by a compound having the structural formula:

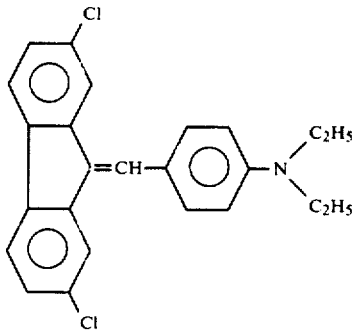

thereby resulting in an electrophotographic element.

Vpo and E1/2 were measured with the resulting electrophotographic element. The obtained results were as follows:

Vpo = −1160 V:E1/2 = 3.0 lux·sec.

EXAMPLE 8

The electrophotographic elements obtained according to Examples 6 and 7 were charged negatively respectively by means of a copying machine on the market and then subjected to the irradiation of light through originals with the formation of electrostatic latent images. The electrostatic latent images were then developed by means of dry developers having positively charged toners. The developed images were electrostatically transferred onto papers of fine quality and fixed. The obtained images were of high distinction. The images obtained by using wet developers were also distinct to the same extent as in the former.

EXAMPLE 9

A photosensitive layer-forming liquid was prepared by pulverizing and mixing a mixture of 1 part of chlorodian blue and 158 parts of tetrahydrofuran in a ball mill, adding to the same 12 parts of a compound having the structural formula:

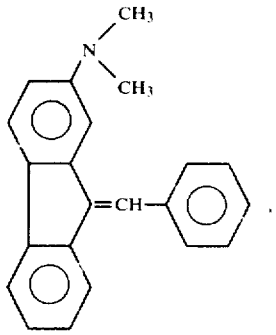

and 18 parts of polyester resin (namely, Polyester Adhesive 49000) and further mixing. This liquid was applied onto an aluminum vacuum evaporated polyester resin by means of a doctor blade, and the same was dried at a temperature of 100° C. for 30 minutes with the formation of a 16 μ-thick photosensitive layer, thereby resulting in an electrophotographic element of the present invention.

This electrophotographic element was subjected to +6 KV corona discharge by means of the same device as used in Example 1 and thus charged positively. Vpo and E1/2 were likewise measured therewith. The obtained results were as follows:

Vpo = 1330 V:E1/2 = 3.6 lux·sec.

EXAMPLE 10

An electrophotographic element was prepared by the same procedure as Example 9 except that the charge producing pigment was replaced by a disazo pigment having the structural formula:

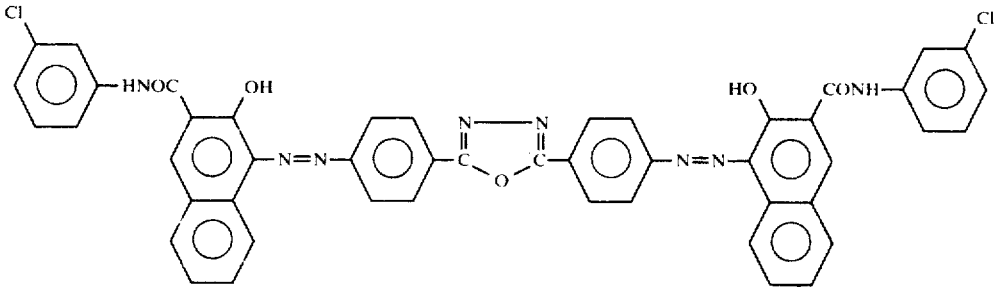

and the charge transport substance was replaced by a compound having the structural formula:

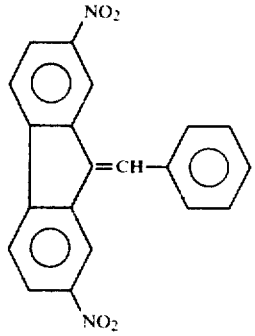

Vpo and E1/2 were measured with this electrophotographic element. The obtained results were as follows:

Vpo = 1260 V:E1/2 = 9.8 lux·sec.

EXAMPLE 11

An electrophotographic element was prepared by the same procedure as Example 9 except that the charge producing pigment was replaced by a disazo pigment having the structural formula:

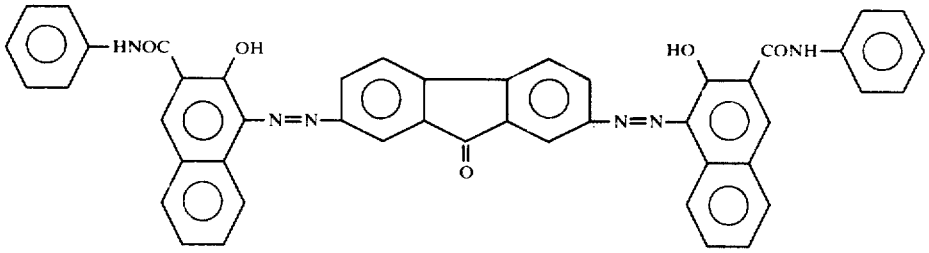

and the charge transport substance was replaced by a compound having the structural formula:

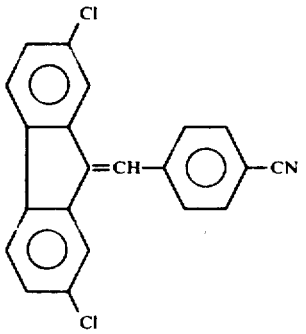

Vpo and E1/2 were measured with this electrophotographic element. The obtained results were as follows:

Vpo = 1270 V:E1/2 = 3.8 lux·sec.

EXAMPLE 12

An electrophotographic element was prepared by the same procedure as Example 9 except that the charge producing pigment was replaced by a trisazo pigment having the structural formula:

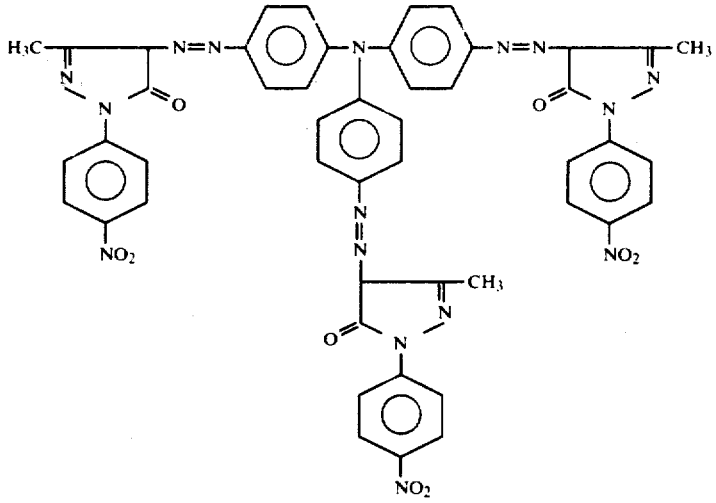

and the charge transport substance was replaced by a compound having the structural formula:

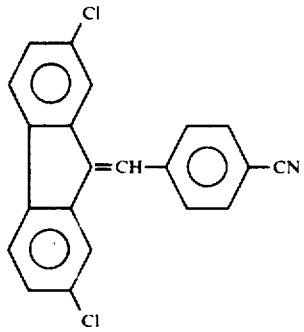

The characteristic properties were measured with this electrophotographic element to show that Vpo is 1190 V and E1/2 is 3.6 lux·sec.

EXAMPLE 13

The electrophotographic elements obtained according to Examples 9 to 12 were charged positively respectively by means of a copying machine on the market and then subjected to the irradiation of light through originals with the formation of electrostatic latent images. The electrostatic latent images were then developed by means of dry developers having negatively charged toners. The developed images were electrostatically transferred onto papers of fine quality and fixed. The obtained images were of high distinction. The images obtained by using wet developers were also distinct to the same extent as in the former.

What is claimed is:

1. An electrophotographic element which comprises an electroconductive support, a charge producing layer consisting essentially of a charge producing substance and a charge transport layer consisting essentially of a charge transport substance having the following general formula and a binder, said layers being superposed on said support in that order:

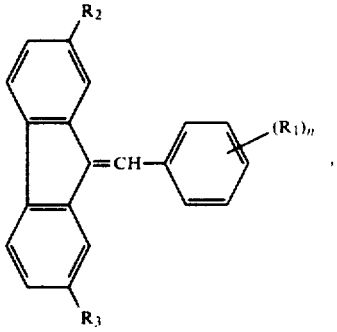

wherein n is the integer 1 or the integer 2, $R_1$ is hydrogen, alkyl, nitro, dialkylamino, alkoxy, nitrile or carboxylic ester group, and $R_2$ and $R_3$ are hydrogen, halogen, nitro or dialkylamino, respectively.

2. An electrophotographic element according to claim 1 wherein the charge producing layer is about 0.05 to 20 μm in thickness and the charge transport layer is about 10 to 100 μm in thickness.

3. An electrophotographic element according to claim 1 wherein the charge transport substance is contained in the range of about 10 to 60 wt. %, based on the weight of the charge transport layer.

4. An electrophotographic element as claimed in claim 1, wherein n is the integer 1, $R_1$ is p-$N(CH_3)_2$, p-$OCH_3$ or hydrogen, $R_2$ is hydrogen and $R_3$ is hydrogen.

5. An electrophotographic element as claimed in claim 1, wherein n is the integer 2, $R_1$ is o-$OCH_3$ and p-$OCH_3$, $R_2$ is hydrogen and $R_3$ is hydrogen.

6. An electrophotographic element as claimed in claim 1, wherein n is the integer 1, $R_1$ is hydrogen, p-$N(C_2H_5)_2$ or p-Cl, $R_2$ is $NO_2$ and $R_3$ is hydrogen.

7. An electrophotographic element as claimed in claim 1, wherein n is the integer 1, $R_1$ is p-Cl, p-$N(C_2H_5)_2$, p-CN or m-$NO_2$, $R_2$ is Cl and $R_3$ is Cl.

8. An electrophotographic element as claimed in claim 1, wherein n is the integer 1, $R_1$ is p-$N(C_2H_5)_2$, $R_2$ is $N(C_2H_5)$ and $R_3$ is hydrogen.

9. An electrophotographic element as claimed in claim 1, wherein n is the integer 1, $R_1$ is hydrogen, $R_2$ is $N(CH_3)_2$ and $R_3$ is hydrogen.

10. An electrophotographic element as claimed in claim 1, wherein n is the integer 1, $R_1$ is hydrogen, $R_2$ is $NO_2$ and $R_3$ is $NO_2$.

11. An electrophotographic element which comprises an electroconductive support, a charge transport layer consisting essentially of a charge transport substance represented by the following general formula and a binder and a charge producing layer consisting essentially of a charge producing substance, said layers being superposed on said support in that order:

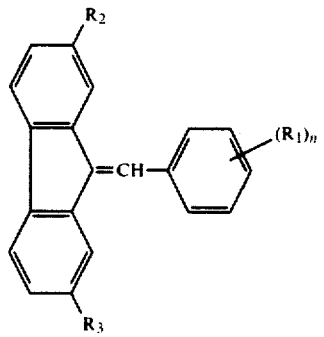

wherein n is the integer 1 or the integer 2, $R_1$ is hydrogen, alkyl, nitro, dialkylamino, alkoxy, nitrile or carboxylic ester group, and $R_2$ and $R_3$ are hydrogen, halogen, nitro or dialkylamino, respectively.

12. An electrophotographic element according to claim 11 wherein the charge transport layer is about 10 to 100 μm in thickness and the charge producing layer is about 0.05 to 20 μm in thickness.

13. An electrophotographic element according to claim 11 wherein the charge transport substance is contained in the range of about 10 to 60 wt. %, based on the weight of the charge transport layer.

14. An electrophotographic element which comprises an electroconductive support and a photosensitive layer superposed thereon, said photosensitive layer consisting essentially of a charge transport substance having the following general formula, a charge producing substance and a binder:

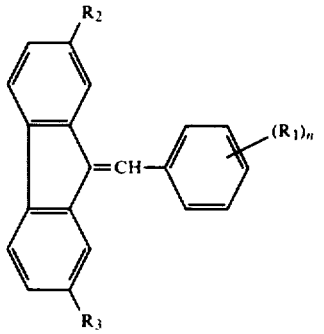

wherein n is the integer 1 or the integer 2, $R_1$ is hydrogen, alkyl, nitro, dialkylamino, alkoxy, nitrile or carboxylic ester group, and $R_2$ and $R_3$ are hydrogen, halogen, nitro or dialkylamino, respectively.

15. An electrophotographic element according to claim 14, wherein the photosensitive layer is about 3 to 100 μm in thickness.

16. An electrophotographic element according to claim 14, wherein the quantities of the charge transport and the charge producing substances are about 10 to 60% and about 1 to 50%, respectively, based on the weight of the photosensitive layer.

* * * * *